US006578637B1

(12) United States Patent
Maus et al.

(10) Patent No.: US 6,578,637 B1
(45) Date of Patent: Jun. 17, 2003

(54) METHOD AND SYSTEM FOR STORING GAS FOR USE IN OFFSHORE DRILLING AND PRODUCTION OPERATIONS

(75) Inventors: L. Donald Maus, Houston, TX (US); Mark E. Ehrhardt, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/626,663

(22) Filed: Jul. 27, 2000

Related U.S. Application Data

(60) Provisional application No. 60/154,569, filed on Sep. 17, 1999.

(51) Int. Cl.[7] ..... E21B 41/06

(52) U.S. Cl. ..... 166/350; 166/380; 405/224.2; 114/331

(58) Field of Search ..... 166/335, 350, 166/355, 359, 367, 380, 381; 175/5, 7, 69, 71, 72; 405/195.1, 224.1, 224.2, 224.3, 224.4, 225, 521; 114/331

(56) References Cited

U.S. PATENT DOCUMENTS

| | | | | | |
|---|---|---|---|---|---|
| 3,017,934 | A | | 1/1962 | Rhodes et al. | 175/7 |
| 3,667,240 | A | | 6/1972 | Vilain | 61/46.5 |
| 3,720,066 | A | | 3/1973 | Vilain | 61/46.5 |
| 3,815,673 | A | | 6/1974 | Bruce et al. | 166/0.5 |
| 3,858,401 | A | | 1/1975 | Watkins | 61/46 |
| 3,992,889 | A | | 11/1976 | Watkins et al. | 61/86 |
| 4,091,881 | A | * | 5/1978 | Maus | 175/25 |
| 4,099,560 | A | | 7/1978 | Fischer et al. | 166/0.5 |
| 4,099,583 | A | * | 7/1978 | Maus | 175/25 |
| 4,176,986 | A | | 12/1979 | Taft et al. | 405/211 |
| 4,216,834 | A | * | 8/1980 | Wardlaw | 166/350 |
| 4,422,801 | A | | 12/1983 | Hale et al. | 405/195 |
| 4,545,437 | A | | 10/1985 | Denison | 166/345 |
| 4,616,707 | A | | 10/1986 | Langner | 166/345 |
| 4,636,114 | A | | 1/1987 | Hale | 405/224 |
| 4,646,840 | A | | 3/1987 | Bartholomew et al. | 166/350 |
| 5,006,845 | A | | 4/1991 | Calcar et al. | 340/853 |
| 5,706,897 | A | | 1/1998 | Horton, III | 166/359 |
| 6,328,107 | B1 | * | 12/2001 | Maus | 166/335 |

* cited by examiner

*Primary Examiner*—David Bagnell
*Assistant Examiner*—Jennifer H Gay

(57) ABSTRACT

Gas storage is provided for a subsea gas-lifted riser during offshore drilling and/or production operations. One or more gas storage chambers positioned along and about the subsea riser are connected to a gas conduit. Each chamber has at least one valve for controlling passage of gas out of the chamber and into the gas conduit. The valves serve to allow the gas from the storage chambers to be injected as lift gas as needed.

1 Claim, 5 Drawing Sheets

METHOD AND SYSTEM FOR STORING GAS FOR USE IN OFFSHORE DRILLING AND PRODUCTION OPERATIONS

This application claims the benefit of U.S. Provisional Application No. 60/154,569 filed Sep. 17, 1999.

FIELD OF THE INVENTION

This invention relates generally to underwater storage of gas used in offshore drilling and production operations. More particularly, the invention pertains to a method and system for storing gas about and along drilling and/or production risers.

BACKGROUND OF THE INVENTION

In the drilling and production of offshore wells, it may be advantageous to store gas for use in the drilling and production operations. Large quantities of gas, such as air or nitrogen, have been proposed for example to reduce the weight of drilling fluids being returned in an offshore drilling riser.

A drilling riser is typically used in drilling operations from a floating vessel or platform. The drilling riser extends from above the surface of the body of water downwardly to a wellhead located on the floor of the body of water. The drilling riser serves to guide the drill string into the well and provides a return conduit for circulating drilling fluids (also known as "drilling mud" or simply "mud").

It has been recognized that it is desirable for the drilling fluid pressure in the riser at its lower end (at or near the seafloor) to be approximately equal to the pressure of the surrounding seawater. This effectively eliminates problems that arise from using drilling fluid having a density higher than seawater. One promising way of lowering the effective density of the drilling fluid in the riser is to inject a lift gas at the lower end of the riser. The injected gas intermingles with the drilling fluid and reduces the equivalent density of the column of drilling fluid in the riser to that of seawater.

Drilling a well using a gas lifted drilling riser system requires periodic shutdown of the lift gas injection and de-pressuring of the drilling riser. After completion of the activities that required the de-pressuring, restart of the lift gas injection requires a significant volume of lift gas to re-pressurize and re-establish steady-state, lift-gas flow in the riser.

Air and nitrogen are commonly suggested choices for riser lift gas, with nitrogen preferred for safety reasons. Lift gas for re-pressuring the riser can be supplied by installing a lift gas generator. The size of the lift gas generator can be substantially reduced if lift gas storage is available for storing lift gas produced by the generator when no or little new lift gas is required for the drilling operation.

Storing lift gas in pressurized cylinders on board a typical drilling vessel would require a large number of gas cylinders. The weight and space requirements of onboard gas storage would substantially offset the savings of using smaller sized gas generation equipment. One additional difficulty with onboard gas storage is that lift gas supply pressure varies from maximum storage pressure to atmospheric pressure as gas is withdrawn from storage. Storing lift gas as a liquid would reduce the weight and space requirements for lift gas storage and could eliminate variations in supply pressure. However, liquid storage introduces other concerns related to storage of cryogenic liquid and the logistics of lift-gas resupply. A need therefore exists for an effective storage system for handling gas used in drilling and production operations, such as gas lift operations.

SUMMARY

The present invention provides a method and system for storing gas for use in offshore drilling and/or production operations that uses storage chambers positioned along and about a generally upright riser that extends through a body of water. The storage system comprises one or more gas storage chambers positioned along and around an offshore riser and a conduit means operatively connected to the storage chambers for passing gas into and out of the chambers for use in drilling or production operations.

BRIEF DESCRIPTION OF THE DRAWINGS

The present invention and its advantages will be better understood by referring to the following detailed description and the following drawings in which like numerals have similar functions.

The drawings illustrate specific embodiments of practicing the method of this invention. The drawings are not intended to exclude from the scope of the invention other embodiments that are the result of normal and expected modifications of the specific embodiments.

DETAILED DESCRIPTION OF THE INVENTION

The invention will be described in connection with preferred embodiments of a gas storage system for use in supplying gas to a gas lift drilling operation. However, to the extent that the following detailed description is specific to a particular embodiment or a particular use of the invention, this is intended to be illustrative only, and is not to be construed as limiting the scope of the invention. The gas storage system of this invention may also be used in any drilling and production operation that uses one or more risers in which there is a need to store gas for use in the drilling and/or production operations. This invention is intended to cover all alternatives, modifications, and equivalents that are included within the spirit and scope of the invention, as defined by the appended claims.

Gas-Lifted Risers in General

Figure 1B:
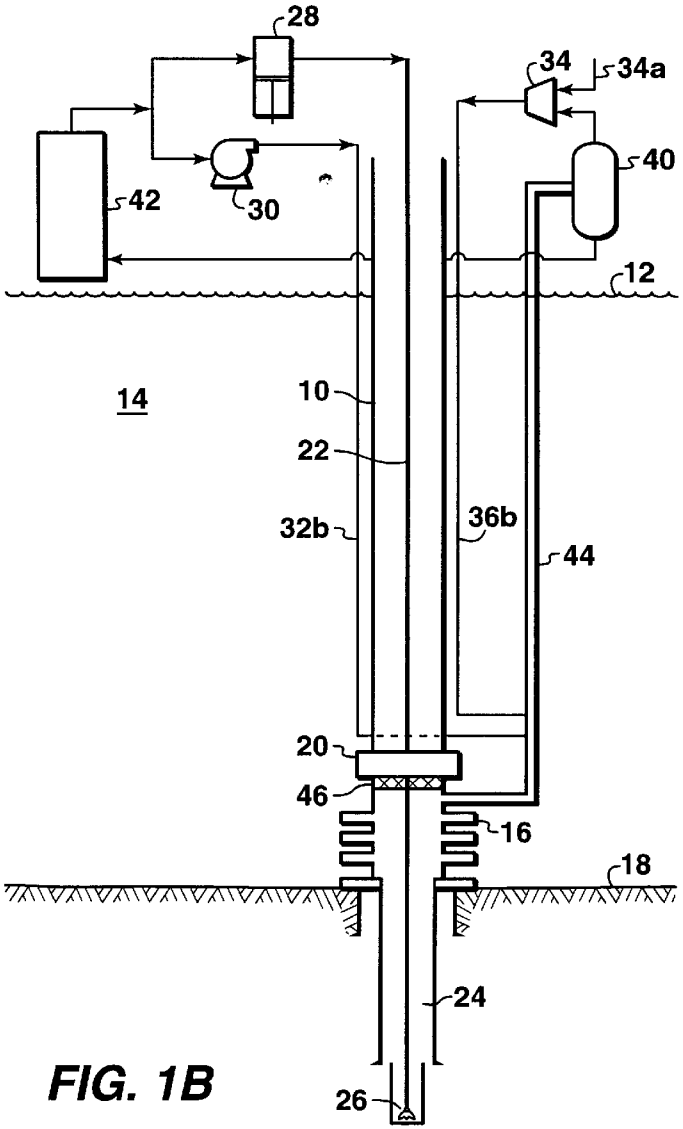
FIGS. 1A and 1B illustrate, respectively, schematic overviews of offshore drilling operations using a gas-lifted drilling riser and offshore drilling operations using a separate gas-lifted mud return riser.
Figure 1A:
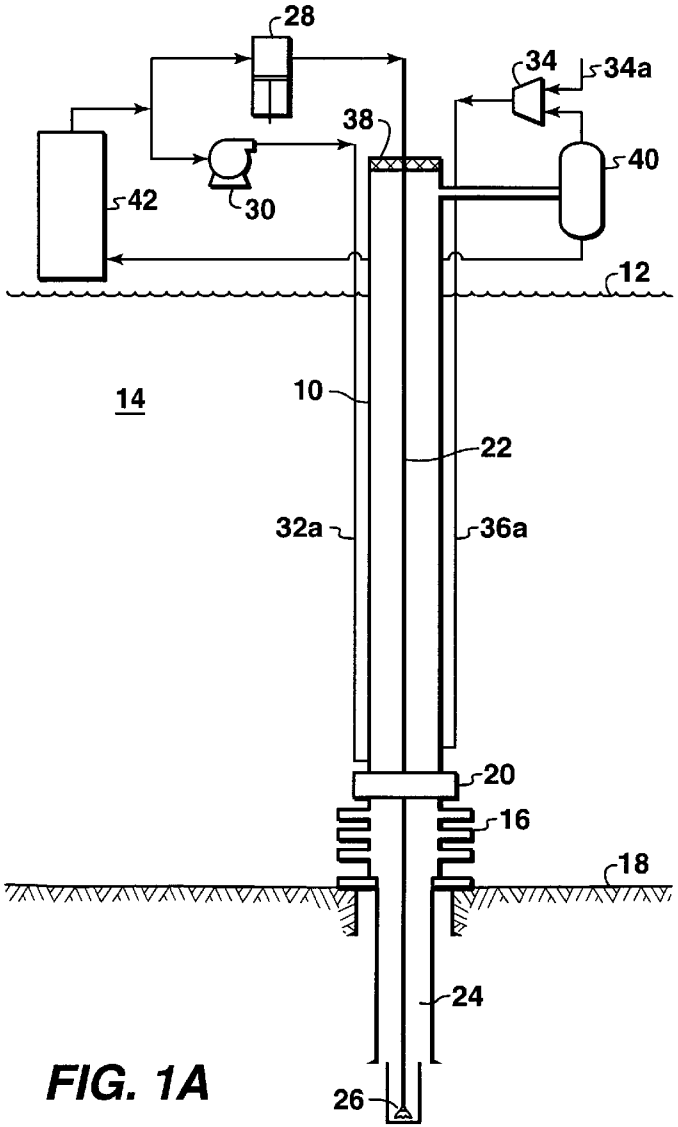

FIG. 1A provides a schematic overview of one form of a gas-lifted drilling system consisting of a conventional marine drilling riser 10 extending from a floating vessel or platform (not shown) at the surface 12 of body of water 14 to a blowout preventer (BOP) stack 16 located on the floor 18 of body of water 14. Typically, riser 10 is from about 16 to 24 inches (40.5 to 61 centimeters) in diameter and is made of steel. A lower marine riser package (LMRP) 20 is used to attach riser 10 to BOP stack 16. Typically, LMRP 20 also contains a flexible element or "flex joint" (not shown in the drawings) to accommodate angular misalignment between riser 10 and BOP stack 16, connectors for various auxiliary fluid, electrical, and control lines, and, in many instances, one or more annular BOPs. As in conventional offshore drilling operations, a drill string 22 is suspended from a drilling derrick (not shown) located on the floating vessel or platform. The drill string 22 extends downwardly through drilling riser 10, LMRP 20, and BOP stack 16 and into borehole 24. A drill bit 26 is attached to the lower end of drill string 22. A conventional surface mud pump 28 pumps drilling mud down the interior of drill string 22, through nozzles in drill bit 26, and into borehole 24. The drilling mud returns to the subsea wellhead via the annular space between drill string 22 and the wall of borehole 24, and then to the surface through the annular space between drill string 22 and riser 10. Also included in a conventional offshore drilling system is a boost mud pump 30 for pumping additional drilling mud down a separate conduit or "boost mud line" 32*a* attached to riser 10 and injecting this drilling mud into the base of riser 10. This increases the velocity of the upward flow in riser 10 and helps to prevent settling of drill cuttings.

Modifications to the conventional drilling system to provide gas-lifting capability include a source (not shown) of lift gas (preferably, an inert gas such as nitrogen), a compressor 34 to increase the pressure of the lift gas, and a conduit or lift gas injection line 36*a* to convey the compressed lift gas to the base of riser 10 where it is injected into the stream of drilling mud and drill cuttings returning from the well. Any suitable source may be used to supply the required lift gas. For example, a conventional nitrogen membrane system may be used to separate nitrogen from the atmosphere for use as the lift gas. Lift gas from the lift gas source enters compressor 34 through source inlet line 34*a*. Following injection of the lift gas into the base of drilling riser 10, the mixture of drilling mud, drill cuttings, and lift gas circulates to the top of riser 10 where it is diverted from riser 10 by rotating diverter 38, a conventional device capable of sealing the annulus between the rotating drill string 22 and the riser 10. The mixture then flows to separator 40 (which may comprise a plurality of similar or different separation units) where the lift gas is separated from the drilling mud, drill cuttings, and any formation fluids that may have entered borehole 24. The separated lift gas is then routed back to compressor 34 for recirculation. Preferably, separator 40 is maintained at a pressure of several hundred pounds per square inch to stabilize the multiphase flow in riser 10, reduce flow velocities in the surface components, and minimize compressor horsepower requirements. The mixture of drilling fluid and drill cuttings (and, possibly, formation fluids) is removed from separator 40, reduced to atmospheric pressure, and then routed to conventional drilling mud processing equipment 42 where the drill cuttings are removed and the drilling mud is reconditioned for recirculation into the drill string 22 or boost mud line 32*a*.

FIG. 1B illustrates an alternate gas-lift arrangement in which the return flow from the well is diverted from the drilling riser 10 into a separate mud return riser 44. If desired, a plurality of mud return risers may be used. A rotating diverter 46 located on top of BOP stack 16 serves to divert the drilling mud and drill cuttings into the mud return riser 44 and to separate the drilling mud in the well from the seawater with which the drilling riser 10 is filled. Lift gas, mud and boost mud are injected into the base of mud return riser 44 through lift gas injection line 36*b* and boost mud line 32*b*, respectively. The mud return riser 44 may be attached to the drilling riser 10 or may be located more remotely from it. If the mud return riser 44 is located remotely, the boost mud line 32*b* and lift gas injection line 36*b* may be attached to the mud return riser 44 and the drilling riser 10 may be eliminated. The surface equipment for the FIG. 1B embodiment is the same as described above for FIG. 1A, except that a rotating diverter is not required at the top of the drilling riser or the mud return riser 44.

The following detailed description of the invention will be based primarily on the gas lift embodiment shown in FIG. 1A. However, the invention is equally applicable to the gas lift embodiment shown in FIG. 1B as well as to other drilling and production operations (not shown) in which a supply of gas is needed. Accordingly, the term "gas-lifted riser" will be used hereinafter to denote either a gas-lifted drilling riser in accordance with FIG. 1A or a separate gas-lifted mud return riser in accordance with FIG. 1B.

Figures 2A, 2B, 2C:
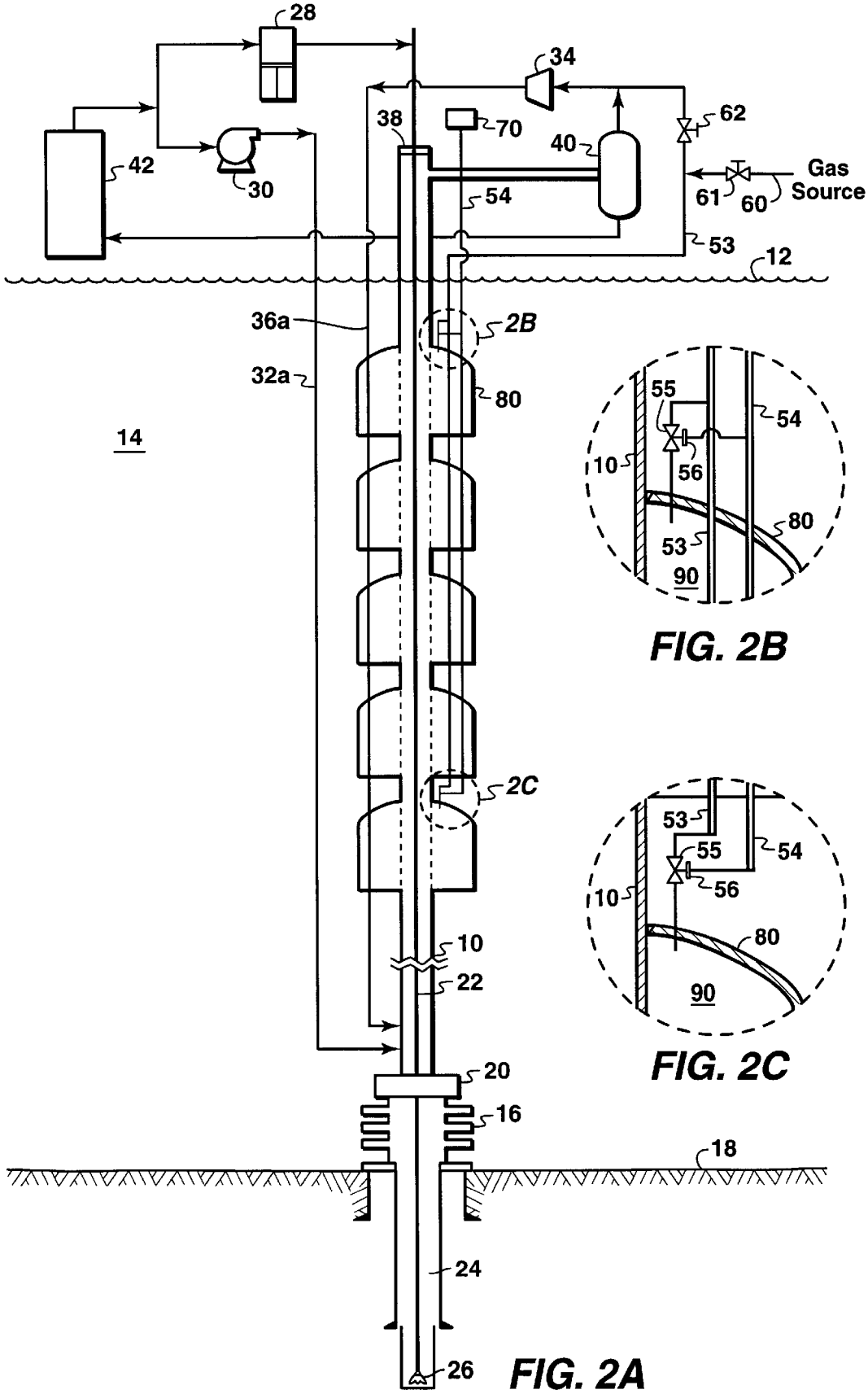
FIG. 2A illustrates a schematic overview of the gas-lifted drilling operation depicted in FIG. 1A having five gas storage chambers of the present invention positioned about and along the riser.
FIGS. 2B and 2C illustrate enlargements of the circled areas 2B and 2C of FIG. 2A.
Figure 3:
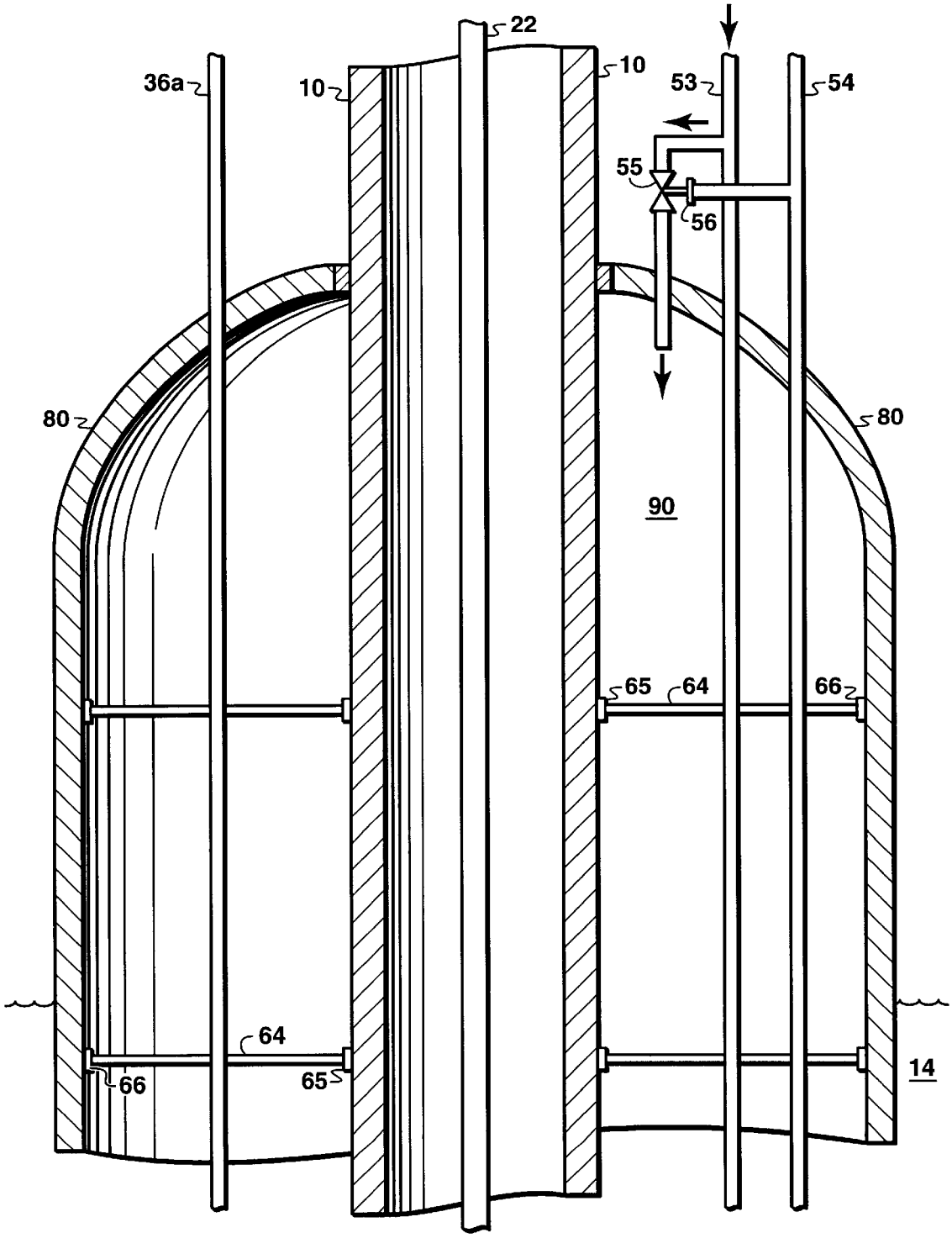
FIG. 3 is an enlarged, partially sectional elevation view of one embodiment of a gas storage chamber.

FIG. 2A schematically illustrates five annular shells 80 positioned about and along riser 10 to provide gas storage for gas lift in the riser 10. FIG. 3 shows a sectional elevation view of the uppermost annular shell 80, with a portion of the shell removed to show storage chamber 90. In the preferred embodiment, chamber 90 is formed by annular shell 80 suitably attached to riser 10, preferably by welding steel shell 80 to the outer surface of riser 10, to form an airtight seal between the shell 80 and riser 10 at the top of shell 80. A number of centralizers 64 mounted along the length of the annular shell 80 maintain the shell a fixed distance from the outer surface of riser 10. The contemplated centralizers 64 comprise rings 65 that are sized to fit around riser 10 and rings 66 are sized to abut the inside surface of the annular shell 80. The rings 65 are preferably rigidly connected to rings 66 by rods or bars. The shell 80 preferably does not have a seal at its bottom and seawater is free to rise inside chamber 90. It is also preferable that shell 80 be of a diameter that permits running of the riser joints through the drilling rig diverter 38 and rotary table (not shown in the drawings).

Gas, such as nitrogen, air, or other gas to be used for drilling and/or production operation, enters storage chambers 90 through one or more fluid conduit lines. Preferably one fill/empty line 53 is used to fill all chambers 90 (add gas to) and empty (remove gas from) all chambers 90. Gas flow between the chambers 90 and fill/empty line 53 can be controlled by opening and closing one or more fill/empty valves 55. Referring to FIG. 2A, to fill a chamber 90 with gas, the gas, which can be provided by any available source such as a gas generator onboard a ship (not shown), is passed through line 60 through open valve 61 into line 53. During the gas-filling operation, valve 62 is closed. Referring to FIG. 2B, from line 53, the gas is passed through open valve 55 into the upper portion of each chamber 90.

Although more than one fill/empty line can be used to control gas flow into and out of each storage chamber 90, preferably only one fill/empty valve 55 is used for each chamber. Fill/empty valves 55 can be opened and closed by any suitable control means such as an electrical, pneumatic, or hydraulic control system that permits remote opening and closing of fill/empty valves 55. The fill/empty valves 55 are preferably actuated by pneumatic or hydraulic control lines from a floating vessel, which for a gas lift operation would be a drilling vessel. FIG. 2A schematically illustrates a pressure control system 70 positioned above the surface of the water 14, preferably aboard a ship, which controls pressure in control line 54. Fluid pressure in line 54 controls valve actuators 56 that opens and closes fill/empty valves 55 in response to predetermined pressure levels in line 54. Individual valve actuators, schematically shown in FIGS. 2B, 2C, and 3 by blocks 56, are preferably configured to apply local seawater pressure to an actuator diaphragm/piston (not shown) to open fill/empty valves 55. The fill/empty valves 55 close when the pressure in control line 54 exceeds the local sea water pressure on the opposite side of the actuator diaphragm/piston. In such an actuator arrangement, the fill/empty valve 55 associated with shallowest storage chamber 90 opens and closes at the lowest pressure used in control line 54 and the fill/empty valve 55 on the deepest storage chamber opens and closes at the highest pressure used in control line 54. Fill/empty valves 55 on intermediate depth storage chambers 90 close at successively higher control line pressures as the water depth increases. Although not shown in the drawings, preferably the deepest storage chamber 90 is not equipped with a fill/empty valve 55, thereby enabling the deepest chamber to be open to the fill/empty line 53 at all times.

Figure 4:
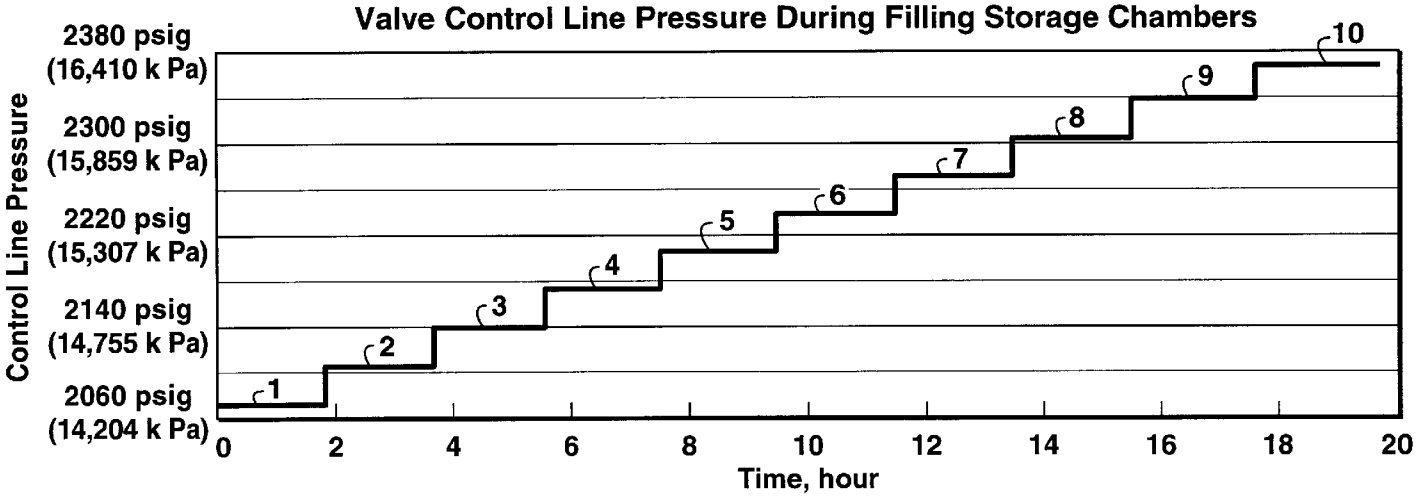
FIG. 4 illustrates step changes in valve control line pressure during filling of storage chambers in the practice of this invention.

FIG. 4 shows a nonlimiting hypothetical example of hydraulic pressures in a control line 54 as a function of time during gas filling of 10 storage chambers (not shown in the drawings) positioned along and about a drilling riser. The pressure stages are numbered 1 through 10 from the shallowest to deepest. The pressure of line #1 represents the pressure for closing the fill/empty valves 55 associated with the shallowest chamber and the pressure of line #10 represents the pressure for closing the fill/empty valve 55 associated with the deepest chamber. The density of the fluid used in the control line 54 determines the pressure at control system 70 required to close the fill/empty valves 55. In order to maximize the difference in control pressure required to close successive fill/empty valves 55, a low-density control fluid is preferably used in control line 54. A nonlimiting example of a suitable control fluid is air.

To fill the storage chambers 90 with lift gas, the pressure of control line 54 at the drilling vessel is preferably reduced to at or near atmospheric pressure so that all fill/empty valves 55 are open. Lift gas is pumped down the fill/empty line 53 and fills the shallowest storage chamber first. As the shallowest storage chamber fills, the pressure of the fill/empty line 53 at the surface will increase until the storage chamber is full. When the shallowest storage chamber is full, the pressure will remain constant as gas spills from the bottom of the storage chamber. Once the shallowest storage chamber is full, the fluid pressure in control line 54 is increased so that the fill/empty valve 55 associated with the shallowest storage chamber 90 closes and the next lower storage chamber begins to fill. This process is repeated until all the storage chambers 90 are full. Once all the storage chambers are filled with gas and if the deepest storage chamber has a fill/empty valve 55 associated with it, pressure in control line 54 is preferably increased another 50 psi and is maintained at that level to ensure that all storage valves remain closed until the stored gas is needed to re-pressurize the riser 10. More preferably, however, as stated above the deepest storage chamber 90 remains open to the fill/empty line 53 to provide a ready source of lift gas, thus obviating the need for a fill/empty valve 55 for the deepest storage chamber.

When a need arises for lift gas from the storage chambers, lift gas may be withdrawn first from the deepest storage chamber through fill/empty line 53. When deepest storage chamber is empty, the pressure in control line 54 is lowered further to open the valve 55 on the next shallowest storage chamber 90. Storage chambers 90 are emptied in succession up the riser 10 until sufficient gas has been removed to re-establish steady gas lift operation in riser 10.

If desired, the lift gas in chambers 90 can be optionally dumped, at least in part, to the ocean 14 by rapidly reducing the pressure in control line 54 to a pressure, preferably atmospheric pressure, that opens all fill/empty valves 55. When the fill/empty valves 55 are in the open position, gas from the storage chambers 90 below the shallowest storage chamber dumps to the storage chamber above it. Assuming that the storage chamber above is already full of lift gas, the excess gas from the storage chamber below will spill out of the bottom of the storage chamber above. This process will continue in rapid succession, limited only by the gas rate that can be accommodated by the fill/empty line 53. At the completion of this dumping process, only the shallowest storage chamber 90 would remain full of gas.

Figure 5:
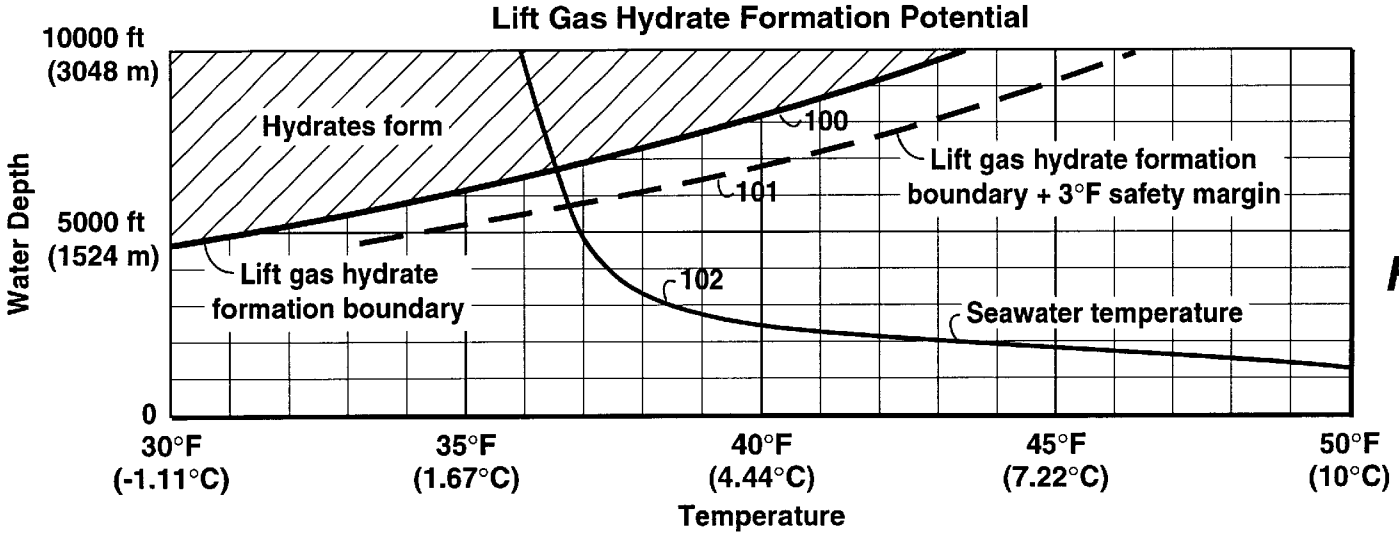
FIG. 5 shows hydrate formation temperature for a typical lift-gas operation as a function of water depth in seawater.

FIG. 5 shows the hydrate formation temperature for a typical lift gas (nitrogen) as a function of water depth (pressure). Hydrates can form if the storage conditions are to the left of the hydrate formation boundary 100. Hydrates will not form if the storage conditions are to the right of the hydrate formation boundary 100. Hydrate prevention measures in the petroleum industry typically include a 3° F. (1.67° C.) margin of safety to account for uncertainty in the hydrate formation temperature. The dashed line 101 shows the hydrate formation boundary with this margin of safety. Also shown in FIG. 5 is a representative curve 102 of seawater temperature as a function of water depth. The water depth corresponding to the intersection between seawater temperature curve 102 and the hydrate formation boundary 101 (which includes the safety margin) is the maximum depth at which the lift gas storage chamber could be located to minimize the potential of hydrate formation in the fill/empty line 53.

Although the drawings schematically show the storage chambers 80 located generally at the upper end of the riser 10, the chambers are preferably located as deep in the water as possible taking into hydrate formation considerations as discussed above and riser behavior during emergency disconnect situations. In addition to hydrate formation, riser behavior during riser emergency disconnects will affect the maximum water depth at which the storage chambers are preferably located. Locating the storage chambers as deep as possible minimizes the number of storage chambers required for a given standard volume of gas since storage pressure is higher at deeper water depths. For risers in water depths less than about 6,000 feet (1830 m), since hydrate formation would typically not be an issue, the maximum storage space would be accomplished by locating the chambers at the bottom of riser 10. However, during a riser emergency disconnect, the storage chambers at the bottom of the riser could result in unacceptable riser behavior, such as too much buoyancy at the bottom of the riser. In most applications, a storage chamber emergency venting system would be necessary for safe operation if the chambers are located at the bottom of the riser. To avoid the additional complexity associated with an emergency venting system, the storage chambers are preferably located at the lowest depth that provides acceptable riser behavior during riser emergency disconnect assuming the storage chambers are full of gas. Persons skilled in the art of offshore drilling operations could optimize the location of the storage chambers along the riser.

Regardless of the water depth and number of the storage chambers 90, top tension requirements of riser 10 can be determined by those skilled in the art. The use of storage chambers 90 will provide a significant component of variable buoyancy since the storage chambers 90 are periodically emptied (either partially or fully) and then refilled. This variance in buoyancy in most offshore applications will not present a problem as long as riser top tension is sufficient to support the riser 10 when the storage chambers 90 are empty of gas. If substantially constant riser buoyancy is desired during removal of gas from one or more storage chambers (for example to reduce the riser top tension requirement), the variable buoyancy of the storage chambers 90 caused by removal of gas from the chambers could be offset by filling a set of depleted storage chambers 90 near the top of the riser with lift gas obtained from deeper storage chambers. The volume of gas at standard conditions required to produce a given buoyancy force decreases as water depth decreases. For instance, the gas volume required to produce a thousand pounds of buoyancy at a 500-foot (152.4 m) water depth is less than 10% of the gas volume required at 5000 feet (1524 m) water depth. Therefore, the diversion of 10% of the gas withdrawn from a storage chamber at 5,000 feet (1524 m) into a storage chamber at 500 feet (152.4 m) would maintain substantially the same total buoyancy force on the riser, albeit at a different position.

EXAMPLE

A simulated example was carried out using a gas lift system schematically illustrated in FIG. 2A. The simulation assumed that the drilling riser 10 had a 21 inch (53.34 cm) outside diameter and was operating in 10,000 feet (3,048 m) of water using a drilling mud weight of 16 ppg (1.92 kg/l) with a riser surface pressure of 400 psig (2,758 kPa). Table 1 indicates that a minimum lift gas storage volume of approximately 1.5 Mscf (0.042 Mscm) would be required for these conditions. As illustrated in FIG. 5, hydrate formation is a possibility at water depths below about 5,800 feet (1,768 m). Therefore, in this example the bottom of the riser joint with the deepest storage chamber was assumed to be located at 5,500 feet (1,676 m). Table 2 summarizes the assumed storage chamber dimensions and the size of lines penetrating the storage chamber. Table 3 shows that for these dimensions, ten storage chambers 90 of the design shown in FIG. 3 would be required to store 1.5 Mscf (0.042 Mscm) of nitrogen. Each storage chamber would produce a variable buoyancy force of approximately 50 kips (22,680 kg).

To maximize the economic benefit of a gas lift system for this example, the time necessary to restart gas lift gas circulation and achieve steady-state operation should be no longer than the time it takes to lower the drill bit 26 from the water's surface to the blow-out presenter on the seafloor. In 10,000 feet (305 m) of water, assuming a top drive drilling operation that adds 90 feet (27.4 m) of drill pipe every 2 to 3 minutes, a one-way trip would take about 4 to 5 hours. The source of the lift gas must be capable of re-pressuring the riser in approximately 2 to 3 hours in order to provide at least 2 hours for the lift gas circulation to reach steady state operation. For this example, a lift gas source of approximately 18 Mscf/d (897 kg mole/hr) would be required to refill the riser in 2 hours.

Figure 6:
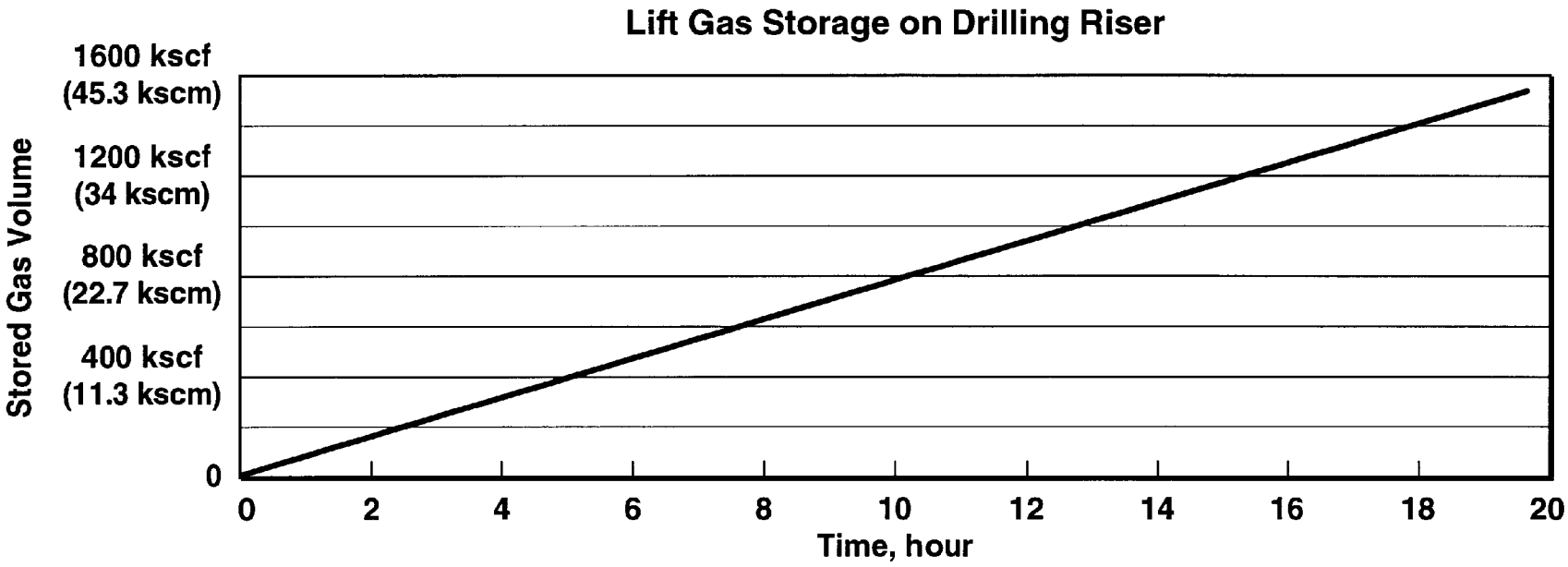
FIG. 6 graphically illustrates the time required to fill the storage chambers used in the example presented in the description.

Without lift gas storage, a significant amount of drilling vessel deck space would be necessary to accommodate lift gas generation equipment with a capacity of 18 Mscf/d (897 kg mole/hr). Providing ten gas storage chambers on the drilling riser would permit the installation of much smaller lift gas generation equipment since gas directly from storage could be provided at this rate. FIG. 6 shows the amount of gas stored for the above example as a function of time assuming a filling rate of 1300 scf/min (36.8 scm/min). At this filling rate, the 1.5 Mscf (0.042 Mscm) inventory of gas can be stored in about 19¼ hours. Riser re-pressuring operations are not expected to exceed a frequency of once per day. Therefore, the lift gas generator can be limited to a size that produces gas at a rate necessary to recharge the storage chambers 90 while drilling is underway. It is therefore shown by this example that the storage system of this invention can reduce substantially the size of the gas generator in a gas lift operation for offshore drilling risers.

A person skilled in the art, particularly one having the benefit of the teachings of this patent, will recognize many modifications and variations to the specific gas storage method and system disclosed above. For example, a variety of gases could be used in the storage system for a variety of purposes in accordance with the invention. As discussed above, the specifically disclosed embodiments and examples should not be used to limit or restrict the scope of the invention, which is to be determined by the claims below and their equivalents.

TABLE 1

Drilling Riser Lift Gas Inventory for 21 inch (53.34 cm) Riser

| Water Depth | Riser Surface Pressure - | Drilling Fluid Density - | Riser Lift Gas Inventory - |
|---|---|---|---|
| 5000 ft (1,524 m) | 200 psig (1,379 kPa) | 16 ppg (1.92 kg/l) | 0.35 Mscf (0.00991 Mscm) |
| 5000 ft (1,524 m) | 400 psig (2,758 kPa) | 16 ppg (1.92 kg/l) | 0.46 Mscf (0.01303 Mscm) |
| 10000 ft (3,048 m) | 200 psig (1,379 kPa) | 16 ppg (1.92 kg/l) | 1.03 Mscf (0.02927 Mscm) |
| 10000 ft (3,048 m) | 400 psig (2,758 kPa) | 16 ppg (1.92 kg/l) | 1.30 Mscf (0.03682 Mscm) |

TABLE 2

Storage Chambers Useable Volume Calculation Assumptions
Lift Gas = Nitrogen

| | |
|---|---|
| Riser (10) OD = | 22.00 inch (55.88 cm) |
| Storage Shell (80) ID = | 56.00 inch (142.2 cm) |
| Storage Shell (80) Length = | 70 feet (21.336 m) |
| Lift Gas Line (36a) OD = | 4.75 inch (16.065 cm) |
| Mud Boost Line (32a) OD = | 4.75 inch (16.065 cm) |
| LMRP/BOP Hydraulic Line (not shown) OD = | 4.75 inch (16.065 cm) |

TABLE 3

Storage Chamber Useable Volume/Buoyancy Calculation Results

| Storage Chamber Number | Water Depth at Bottom of Storage Chamber | Total Nitrogen Volume Stored | Storage Chamber Buoyancy Force | Minimum Nitrogen Pressure in Storage Chamber | Maximum Nitrogen Pressure in Storage Chamber |
|---|---|---|---|---|---|
| 1 | 5472.5 ft (1,668 m) | 162330 scf (4,597.2 scm) | 49.15 kips (22,294.4 kg) | 2405 psig (16,582 kPa) | 2430 psig (16,755 kPa) |
| 2 | 5397.5 ft (1,645.2 m) | 160223 scf (4,537.5 scm) | 49.31 kips (22,367 kg) | 2372 psig (16,355 kPa) | 2397 psig (16,527 kPa) |
| 3 | 5322.5 ft (1,622.3 m) | 158113 scf (4,477.8 scm) | 49.46 kips (22,435.1 kg) | 2338 psig (16,121 kPa) | 2363 psig (16,293 kPa) |
| 4 | 5247.5 ft (1,599.4 m) | 156002 scf (4,418. scm) | 49.62 kips (22,507.6 kg) | 2305 psig (15,893 kPa) | 2330 psig (16,065 kPa) |
| 5 | 5172.5 ft (1,576.6 m) | 153889 scf (4,358.1 scm) | 49.77 kips (22,575.7 kg) | 2272 psig (15,665 kPa) | 2297 psig (15,838 kPa) |
| 6 | 5097.5 ft (1,553.7 m) | 151774 scf (4,298.2 scm) | 49.93 kips (22,648.2 kg) | 2238 psig (15,431 kPa) | 2263 psig (15,603 kPa) |
| 7 | 5022.5 ft (1,530.9) | 149657 scf (4,238.3 scm) | 50.09 kips (22,720.8 kg) | 2205 psig (15,203 kPa) | 2230 psig (15,376 kPa) |
| 8 | 4947.5 ft (1,508 m) | 147538 scf (4,178.3 scm) | 50.24 kips (22,788.9 kg) | 2172 psig (14,976 kPa) | 2197 psig (15,148 kPa) |
| 9 | 4872.5 ft (1,485.1 m) | 145418 scf (4,118.2 scm) | 50.40 kips (22,861 kg) | 2138 psig (14,742 kPa) | 2163 psig (14,914 kPa) |
| 10 | 4797.5 ft (1,462.3 m) | 143295 scf (4,058.1 scm) | 50.55 kips (22,929.5 kg) | 2105 psig (14,514 kPa) | 2130 psig (14,686 kPa) |
| Total | | 1,528,239 scf (43,279.7 scm) | 498.22 kips (225,993 kg) | | |

What we claim is:

1. A method for controlling the pressure at the base of an offshore gas-lift riser used to transport drilling fluid through a body of water, said method comprising the steps of:

(a) withdrawing gas from a plurality of storage chambers about and along the riser;

(b) pressurizing the withdrawn gas; and (c) passing the pressurized gas to the lower end of the riser and injecting the pressurized gas into the lower end of the riser; wherein the storage chambers are open at the bottom to the sea water, each chamber being operatively connected to a gas conduit for removing gas from the chambers, the gas conduit having for each storage chamber at least one valve operatively connected to the gas conduit for controlling passage of gas out of the chambers into the gas conduit, a control line operatively connected to each valve for controlling passage of gas out of the storage chambers, said valves being opened at pressures in the control line below predetermined pressure levels, wherein the step of withdrawing gas from the plurality of storage chambers comprises the steps of:

(i) decreasing the fluid pressure in the control line to a predetermined level, thereby opening the valve associated with a lower chamber of the plurality of chambers and passing gas into the gas conduit;

(ii) decreasing the fluid pressure in the control line to a second predetermined level, thereby opening the valve associated with a second chamber of the plurality of chambers above the lower chamber and passing gas into the gas conduit from the second chamber; and (iii) repeating steps (i) and (ii) for the plurality of storage chambers in succession one chamber at a time up the riser until a desired amount of gas is withdrawn from the storage chambers into the gas conduit.

* * * * *